US006799965B1

(12) United States Patent
Gaudioso

(10) Patent No.: US 6,799,965 B1
(45) Date of Patent: Oct. 5, 2004

(54) CANDLE FLAME EXTINGUISHER

(76) Inventor: Vincent R. Gaudioso, 28 Welch Rd., North Haven, CT (US) 06473

( * ) Notice: Subject to any disclaimer, the term of this patent is extended or adjusted under 35 U.S.C. 154(b) by 97 days.

(21) Appl. No.: 10/264,912

(22) Filed: Oct. 4, 2002

(51) Int. Cl.[7] ..... F23Q 25/00
(52) U.S. Cl. ..... 431/35; 431/289
(58) Field of Search ..... 431/33, 35, 289, 431/291, 297; 264/612, 429, DIG. 58; 535/219, 302

(56) References Cited

U.S. PATENT DOCUMENTS

| | | | | | |
|---|---|---|---|---|---|
| 1,677,919 | A | * | 7/1928 | Hansen | 40/621 |
| 3,371,044 | A | * | 2/1968 | Cochardt | 264/612 |
| 3,985,492 | A | | 10/1976 | Nunemaker | |
| 4,138,211 | A | | 2/1979 | Kampfer et al. | |
| 4,818,214 | A | | 4/1989 | Ronnback | |
| 5,057,005 | A | | 10/1991 | Kwok | |
| 5,899,685 | A | | 5/1999 | Thigpen | |
| 5,971,081 | A | | 10/1999 | Stewart | |
| 6,090,331 | A | * | 7/2000 | Schwarz et al. | 264/405 |
| 6,444,156 | B1 | * | 9/2002 | Schwarz et al. | 264/405 |

FOREIGN PATENT DOCUMENTS

| | | | | |
|---|---|---|---|---|
| DE | 2908519 | * | 9/1980 | |
| DE | 3132960 | * | 10/1982 | |
| DE | 4037398 | * | 5/1992 | |
| DE | 29722689 U1 | * | 3/1998 | C11C/5/00 |
| JP | 9-63353 A | * | 3/1997 | |
| WO | WO 9524588 | * | 9/1995 | |

* cited by examiner

*Primary Examiner*—Sara Clarke
(74) *Attorney, Agent, or Firm*—Carmody & Torrance LLP

(57) ABSTRACT

A candle flame extinguisher assembly for extinguishing a flame of a candle positioned in a candleholder including a platform, wherein the platform includes a first magnet having at least a first polarity; a second magnet, the second magnet being coupleable to the wickbase and having a first polarity that is repelled by the first polarity of the first magnet; wherein the second magnet is positionable in the candleholder and intermediate the candle and a base of the candleholder, the second magnet being initially oriented such that its first polarity is in alignment with the first polarity of the first magnet; wherein upon a sufficient melting of the candle a puddling of melted wax is formed and the repelling force between the respective first polarities of the first and second magnet causes the second magnet to be urged away from the first magnet; and whereby the wick is tipped in a direction towards the melted wax and extinguished therein due in part to the wickbase being coupled to the second magnet. A spring member is also disclosed for providing the urging of the wick to tip over. A method of extinguishing a flame of a candle positioned in a candleholder is also provided.

26 Claims, 5 Drawing Sheets

CANDLE FLAME EXTINGUISHER

BACKGROUND OF THE INVENTION

The present invention relates generally to assemblies for extinguishing the flame of a candle, and more particularly, to an improved candle flame extinguisher assembly that causes the wick of the candle to tip over into the melted wax thereby being extinguished. A method of achieving the foregoing is also provided.

According to the National Fire Protection Association (NFPA), fires resulting from candles result in a high incident of injuries and even death as well as millions of dollars in property damage. Unattended, abandoned or inadequately controlled candles have been cited as a leading cause of home fires. Many fires start in the bedroom, presumably from the person falling asleep without adequately extinguishing the flame. As such, it is highly desirable to extinguish all candles when leaving the room or going to sleep. There are even recommendations as to how to trim candlewicks to reduce the likelihood of fire.

Unfortunately, it is at least very difficult to ensure that all candle users will adhere to all the recommended safety tips. Sadly, therefore, there are bound to be continuing injuries and property damage from the negligent, forgetful or other characterized conduct or omission of candle users.

As such, there is a need for self-extinguishing candle flames. The prior art can be seen to possess certain ideas to achieve this objective, some of which are described in U.S. Pat. Nos. 4,138,211, 4,818,214, 5,057,005, 5,899,685, 3,985,492, and 5,971,081. However, the present inventor believes that such constructions are less than satisfactory, and has set out to improve the state of the art in this regard.

Accordingly, it is desirable to provide a candle flame extinguisher assembly that overcomes certain perceived deficiencies and provides the objects and advantages set forth below.

OBJECTS AND SUMMARY OF THE INVENTION

Specifically, it is an object of the present invention to provide an improved candle flame extinguisher assembly.

It is another object of the present invention to provide an improved candle flame extinguisher assembly that reduces or eliminates the likelihood of fires resulting from unattended to burning candles.

Another object of the invention is to provide an improved candle flame extinguisher assembly that can be easily adapted to be used with conventional candles.

Still another object of the present invention is to provide an improved candle flame extinguisher assembly that is easy and inexpensive to manufacture.

Still a further object of the present invention is to provide an improved a candle flame extinguisher assembly that overcomes the deficiencies in the prior art.

Still another object of the present invention is to provide an improved method of extinguishing a candle flame.

Still other objects and advantages of the invention will in part be obvious and will in part be apparent from the specification.

The invention accordingly comprises the features of construction, combination of elements and arrangement of parts and sequence of steps which will be exemplified in the construction and methodology hereinafter set forth, and the scope of the invention will be indicated in the claims.

The objects and advantages set forth herein are carried out by a candle flame extinguisher assembly constructed in accordance with the present invention.

In a preferred embodiment, the candle flame extinguisher assembly for extinguishing a flame of a candle positioned in a candleholder comprises a platform, wherein the platform includes a first magnet having at least a first polarity; a second magnet, the second magnet being coupleable to the wickbase and having a first polarity that is repelled by the first polarity of the first magnet; wherein the second magnet is positionable in the candleholder and intermediate the candle and a base of the candleholder, the second magnet being initially oriented such that its first polarity is in alignment with the first polarity of the first magnet; wherein upon a sufficient melting of the candle a puddling of melted wax is formed and the repelling force between the respective first polarities of the first and second magnet causes the second magnet to be urged away from the first magnet; and whereby the wick is tipped in a direction towards the melted wax and extinguished therein due in part to the wickbase being coupled to the second magnet.

In a preferred construction, the second magnet is embedded in a wax insert, the wax insert being positionable in the candleholder between the base of the candleholder and the wickbase; wherein upon the sufficient melting of the candle, the insert is sufficiently melted to at least one of allow the second magnet to couple to the wickbase and permit the second magnet to be urged away from the first magnet. The wax insert may also be tapered so as to ensure the proper alignment of the first polarity of the first magnet and the first polarity of the second magnet.

In another embodiment, the assembly comprises a wax member, into which is embedded a base; and a spring member coupled to the base, wherein the spring member comprises a material that is attracted to the wickbase; wherein the wax member is positionable in the candleholder and intermediate the candle and a base of the candleholder, the spring member being in a compressed position when embedded in the wax member; wherein upon a sufficient melting of the candle and wax member, the spring member is urged towards an extended and tilted position so that the wick is tipped in a direction towards the melted wax and extinguished therein.

A specific feature of the present invention is the providing of the wax insert for use in the candle flame extinguisher assembly disclosed above and below.

In yet two other embodiments, the candle flame extinguisher assembly may comprise a platform, wherein the platform includes a first magnet having at least a first polarity; a second magnet, the second magnet having a first polarity that is repelled by the first polarity of the first magnet, wherein the second magnet is positionable in the candleholder and intermediate the candle and a base of the candleholder, the second magnet being initially oriented such that its first polarity is in alignment with the first polarity of the first magnet; wherein upon a sufficient melting of the candle a puddling of melted wax is formed and the repelling force between the respective first polarities of the first and second magnet causes the second magnet to be urged away from the first magnet; and wherein the urging of the second magnet away from the first magnet causes the candle to be tipped in a direction such that the wick is tipped towards the melted wax and extinguished therein. Alternatively, the candle flame extinguisher assembly may comprise a platform on which the candleholder is positionable, wherein the platform includes a magnet having at least a first polarity in an orientation that creates a repelling force between the first magnet and the wickbase; wherein upon a sufficient melting of the candle a puddling of melted wax is formed and the repelling force between the first polarity of the first magnet causes the wickbase to be urged away from the magnet; and whereby the wick is tipped in a direction towards the melted wax and extinguished therein due in part to the wickbase being urged away from the magnet. In this latter embodiment, the wickbase is made of metal or of a magnetic material.

Lastly, methods of extinguishing a flame of a candle positioned in a candleholder, using the assemblies disclosed above, are also provided.

BRIEF DESCRIPTION OF THE DRAWINGS

Like parts will be identified by like reference numbers in the figures, but not every part will be provided with a reference number, and this should not be construed in a limiting manner.

DETAILED DESCRIPTION OF THE PREFERRED EMBODIMENTS

Figure 1:
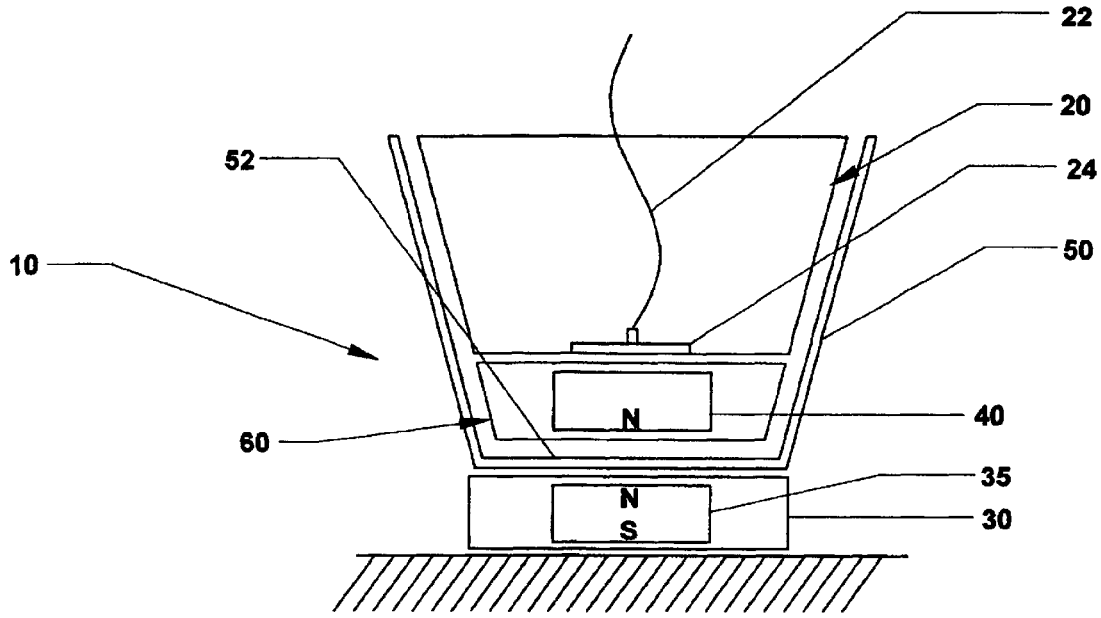
FIG. 1 is a partial cross sectional view of a candle flame extinguisher assembly constructed in accordance with a first embodiment of the present invention, in combination with a conventional candle and candleholder.

Reference is first made to FIGS. 1–4 for a disclosure of a candle flame extinguisher assembly, generally indicated at 10, for extinguishing a flame of a candle positioned in a candleholder, constructed in accordance with a first embodiment of the present invention.

It shall be understood that the present invention can be used and appreciated with a wide range of candles, the minimum requirements preferably being that the candle, generally indicated at 20 in the figures, includes a wick 22 and a wickbase 24 (although the fourth embodiment does not require the wickbase to operate). Preferably, wickbase 24 is coupled, such as by example and not limitation, knotting or melting or friction fitting, to wick 22. This technique is old in the art.

In accordance with the present invention, assembly 10 comprises a platform 30 which can be made out of a wide range of materials, such as plastic, clay, metal, wood, ceramic or another desired material. Preferably, the material for platform 30 is of a non-combustible material. Inside platform 30 is disposed a magnet 35. Magnet 35 can be positioned anywhere in platform 30, including totally within or at the surface, as long as it can provide sufficient repelling force as discussed below. Depending on the material used to construct platform 30, magnet 35 can be positioned after formation of the platform 30 or during the molding thereof. Also, while magnet 35 would typically have two polarities (a north "N" and a south "S"), only one polarity is actually needed to achieve the objectives set forth herein.

Assembly 10 also comprises a second magnet 40. Second magnet 40 is preferably positioned in a candleholder 50 (which itself may be comprised of glass, plastic or other suitable material) and intermediate candle 20 and a base (or bottom) 52 of candleholder 50. Candleholder 50 sits on platform 30. Second magnet 40 is preferably initially oriented such that its first polarity (i.e. north "N" in this example) is in alignment with the first polarity (i.e. north "N") of magnet 35 so that there is a repelling force between the respective first polarities of the magnets 35, 40. It is also preferable that the second polarity (i.e. south "S") of second magnet 40 is attracted (i.e. so as to be coupleable) to wickbase 24. Hence, it is preferably that wickbase 24 is made of metal or other magnetic material.

Figure 2:
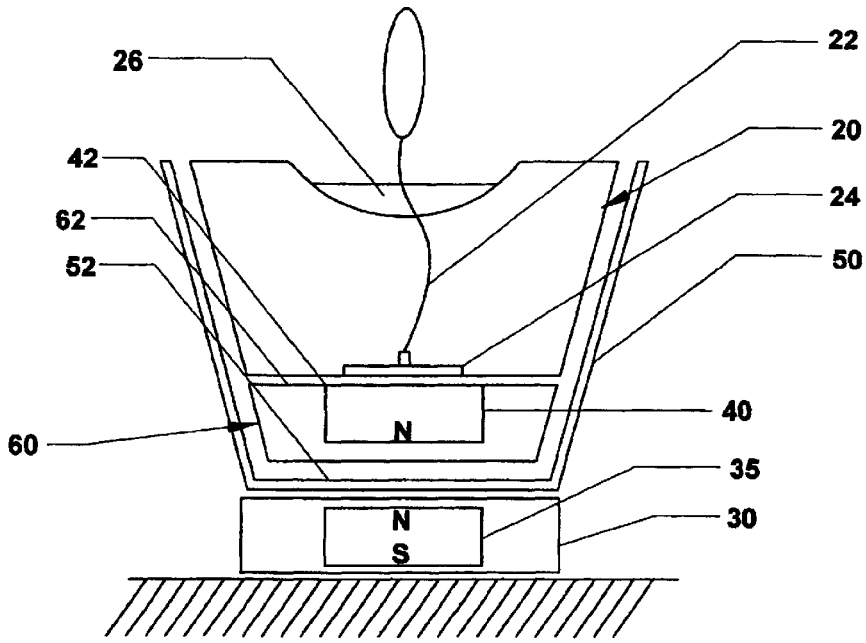
FIG. 2 is a slight variation of the assembly illustrated in FIG. 1.

As shown most clearly in FIGS. 1 and 2, second magnet 40 may be embedded in a wax insert, generally indicated at 60. Wax insert 60 is advantageous in ensuring because of its size and weight, that magnet 40 does not prematurely flip over when it is placed in the bottom of candleholder 50. Wax insert 60, with magnet 40 embedded therein, may be decorated or formed of a matching wax as candle 20 so as to appear as one unit. Likewise, a different color wax may increase the aesthetic beauty of assembly 10. Importantly, wax insert 60 should be properly oriented to ensure the same polarities (i.e. "N" and "N") of the magnets 35, 40 are aligned, as discussed above. Accordingly, tapering of the wax insert shape to specifically fit the bottom of the candleholder 50 or providing small indicia thereon with orientation directions (i.e. up/down) can assist to ensure proper orientation. As would therefore be understood, wax insert 60 is positioned in candleholder 50 between the bottom (base) 52 of candleholder 50 and wickbase 24.

FIGS. 1 and 2 illustrate essentially the same features of this first embodiment, the difference being that magnet 40 can be seen to be fully embedded (FIG. 1) in wax insert 60 or only partially embedded (FIG. 2) such that a top surface 42 of magnet 40 is about flush with a top surface 62 of wax insert 60. From this slight variation, it can be seen that FIG. 2 will permit the coupling of magnet 40 and wickbase 24 much earlier in time than that provided by the embodiment of FIG. 1, as will be understood below. Also FIGS. 1 and 2 illustrate magnet 40 being much greater in diameter then wickbase 24. In practice, it has been found that magnet 40 need not be as large as that illustrated. In fact, magnets 40 of about the same size as wickbase 24 have been found to work well. Therefore, the figures should not be construed as being drawn to scale.

Figure 3:
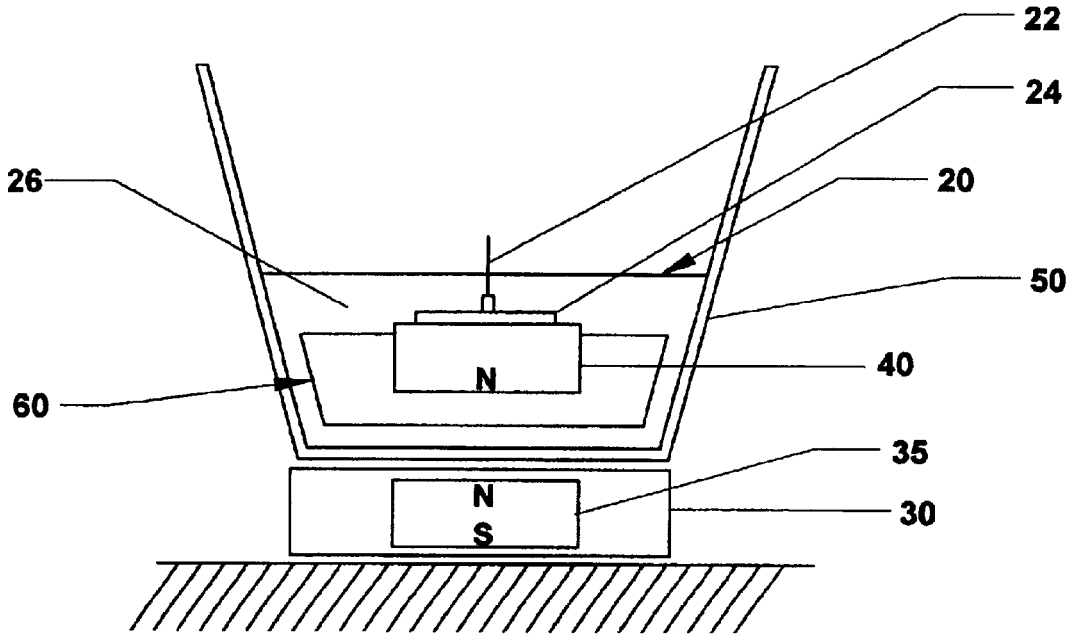
FIG. 3 is an elevational view of the assembly of FIGS. 1 or 2 at a point in time when a certain amount of candle wax has melted.

Specifically, the assembly 10 works to extinguish the flame of candle 20 as follows:

Candle 20 will melt as a flame on wick 22 burns thereby creating a puddling of melted wax 26 (FIG. 2). Upon a sufficient melting of candle 20, a greater puddling (amount) of melted wax 26 is formed (see FIG. 3). In fact, FIG. 3 illustrates that it is possible (but not required) that the entire candle 20 has melted, along with a portion of wax insert 60. Preferably, wax insert 60 is sufficiently melted to permit the free movement of magnet 40 therein. In fact, wax insert 60 need only be partially melted, but may in fact be fully melted (not shown). In this way, once the sufficient amount of wax has melted, the repelling force between the respective first polarities (i.e. north "N" of each magnet) of the first magnet 35 and second magnet 40 causes the second magnet 40 to be urged away from first magnet 35.

Figure 4:
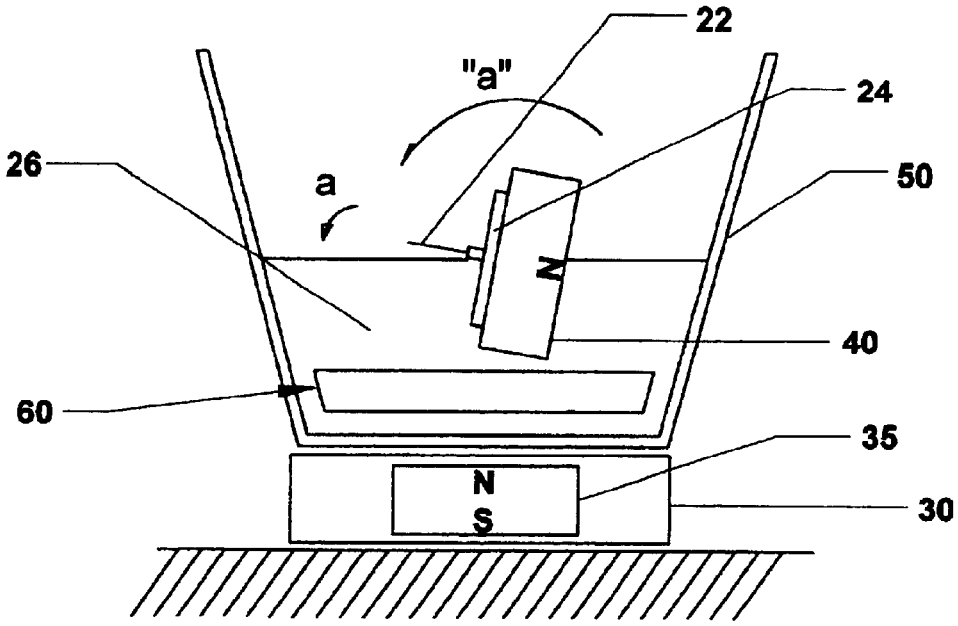
FIG. 4 is an elevational view showing the operation of the invention of the embodiment illustrated in FIGS. 1–3.

More specifically, second magnet 40 will be urged to tip over so as to maximize the distance between the like polarities. In practice, in fact, second magnet will be urged so as to have its second polarity (i.e. south "S") become aligned with the first polarity (i.e. north "N") of the first magnet 35. This is illustrated most clearly in FIG. 4 where magnet 40 is urged in a direction shown by arrow a. In this way, wick 22 is tipped in a direction towards melted wax 26 and extinguished therein due in part to wickbase 24 being coupled to second magnet 40. Eventually, magnet 40 is urged sufficiently for enough to have the flame extinguished (FIG. 4).

As should now be understood, wax insert 60 is not critical to the present invention, although it is preferable for the reasons noted above. With the presence of wax insert 60, upon the sufficient melting of candle 20, the wax insert 60 is sufficiently melted to (a) allow the second magnet 40 to couple to wickbase 24 (if it is not already coupled thereto as illustrated from the initial position of magnet 40 as set forth in FIG. 2) and/or (b) permit second magnet 40 to be urged away from first magnet 35. Also, the proper initial orientation of magnet 40 can be maintained prior to putting candle 20 in the candleholder.

Figure 5:
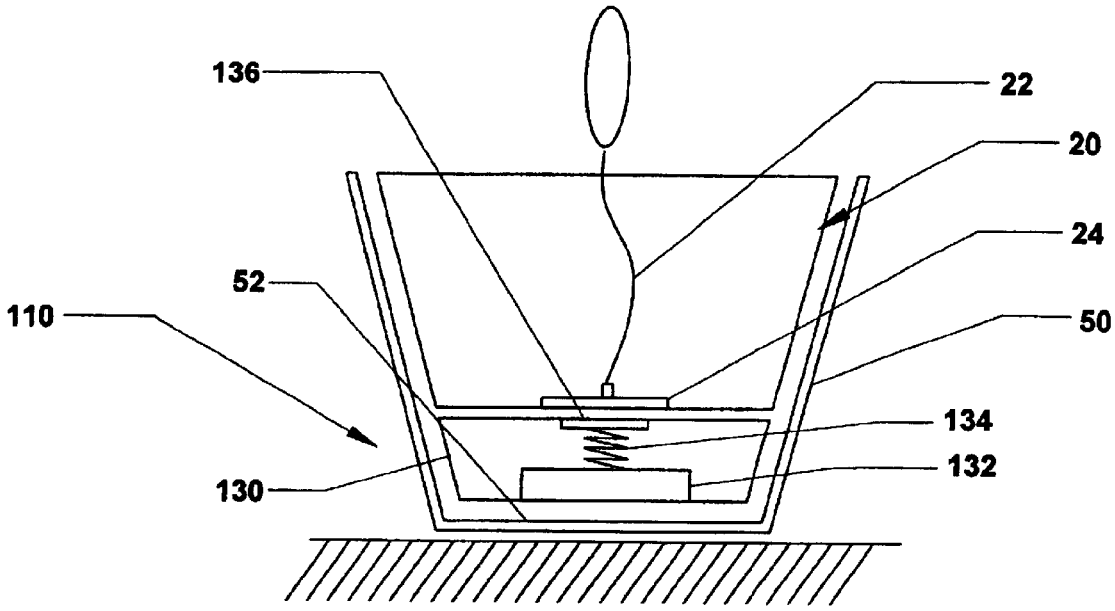
FIG. 5 is a partial cross sectional view of a candle flame extinguisher assembly constructed in accordance with a second embodiment of the present invention.
Figure 6:
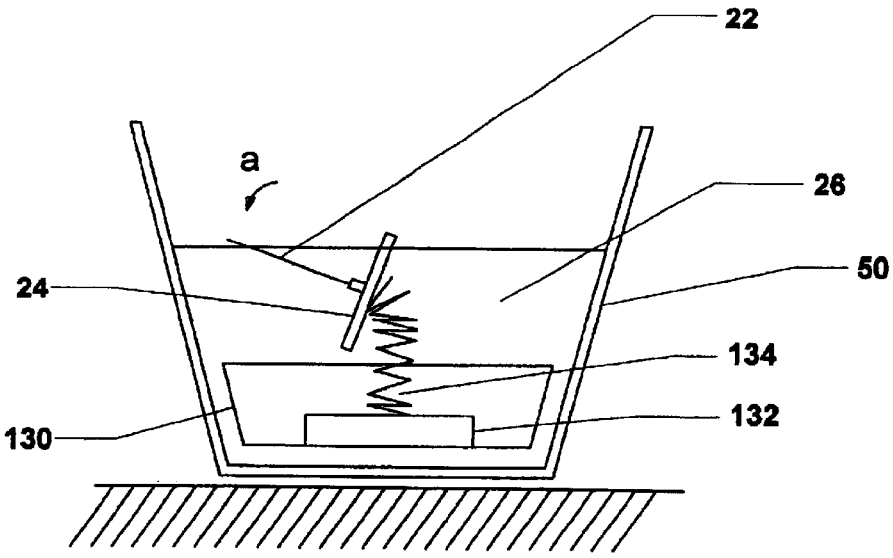
FIG. 6 is an elevational view showing the operation of this second embodiment.

Reference is now made to FIGS. 5 and 6 wherein a candle flame extinguisher assembly, generally indicated at 110, for extinguishing a flame of a candle positioned in a candleholder, constructed in accordance with a second embodiment, is disclosed. The difference in this second embodiment from the first embodiment is that a spring member and not a magnet, provides the urging force to tip the wick 22 into the melted wax 26.

Specifically, in this second embodiment, a wax member 130 is preferably embedded with a base 132 and a spring member 134 coupled to base 132. Reference to the base and/or spring member being "embedded" in wax member 130 should be understood to mean both partially or fully embedded. The amount of "embeddedness" only depends on the ability to carry out the objectives set forth herein, as would be understood by one skilled in the art. The end 136 of spring member not coupled to base 132 preferably is of a magnetic material, has a magnet coupled thereto, or is magnetized so that it is attracted to the wickbase in a manner set forth above.

Wax member 130 is likewise positionable in candleholder 50 and intermediate candle 20 and a base 52 of candleholder 50. As would be expected, spring member 134 is initially in a compressed position (FIG. 5) when embedded in wax member 130.

In operation, and upon a sufficient melting of candle 20 and wax member 130 (FIG. 6), spring member 134 is urged towards an extended and importantly, a tilted position, so that wick 22 is tipped in a direction (arrow "a") towards melted wax 26 and extinguished therein. Accordingly, spring member 134 should be formed so that it is urged both upward and importantly "over" so that it moves in the direction of arrow "a" thus causing the flame on wick 22 to be extinguished in melted wax 26.

Figure 7:
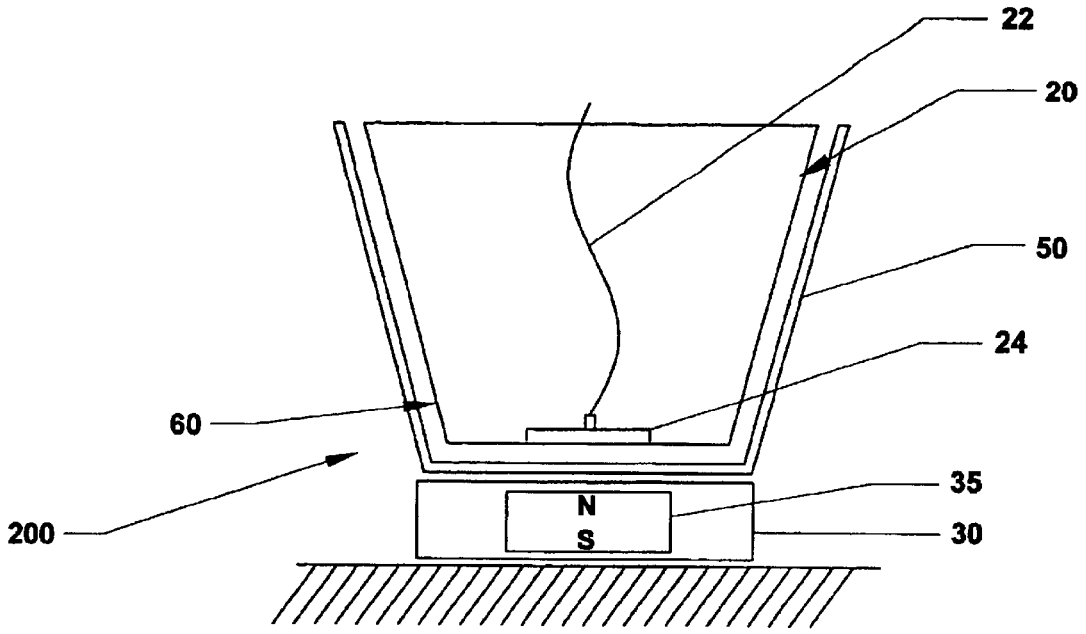
FIG. 7 is a partial cross sectional view of a candle flame extinguisher assembly constructed in accordance with yet a third embodiment of the present invention.
Figure 8:
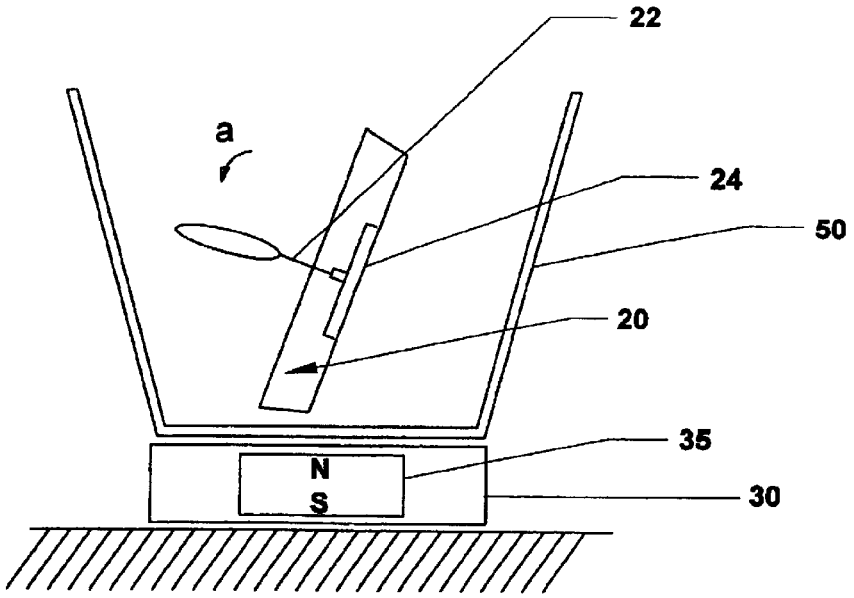
FIG. 8 is an elevational view showing the operation of this third embodiment.

Reference is now made to FIGS. 7–8 for a disclosure of yet a third embodiment of the present invention. In this third embodiment, a candle flame extinguisher assembly, generally indicated at 200, preferably comprises a platform 30 on which the candleholder is positionable, wherein platform 30 includes a magnet 35 having at least a first polarity in an orientation that creates a repelling force with the wickbase 24 of candle 20. Upon a sufficient melting of candle 20, a puddling of melted wax is formed and the repelling force between the first polarity of magnet 35 overcomes the weight of what remains of the candle and causes wickbase 24 to be urged away from magnet 35. The urging force is sufficiently strong enough so as to cause the entire remaining portion of the candle to tip (see arrow "a" in FIG. 8), whereby wick 22 is tipped in a direction (i.e. arrow "a") towards the melted wax and extinguished therein due in part to wickbase 24 being urged away from magnet 235. The repelling force needs to be great enough to both provide the necessary force to urge/tip the remaining portion of candle 20 over as shown in FIG. 8. Here, therefore, a large part, if not all, of the candle needs to melt. Also, as the candle is tipped as in FIG. 8, the physical distance between wickbase 24 and candle 35 will increase. The size of the magnet and the wickbase must therefore be selected to as to ensure the candle is able to be urged sufficiently over. Such minor experimentation is well within the purview of one skilled in the art as one would merely have to experiment with different size candles and magnets and wickbases to ensure the proper operation when the wax is melting or has sufficiently melted.

To best carry out the operation contemplated by this embodiment, wickbase 24 is preferably made of metal or of a magnetic material (such as a magnet itself). In this way, it can easily be seen that it is preferable that the surface of the wickbase in facing alignment with the first polarity of magnet 35 be of the same polarity (i.e. so as to repel) as the first polarity of magnet 35.

Figure 9:
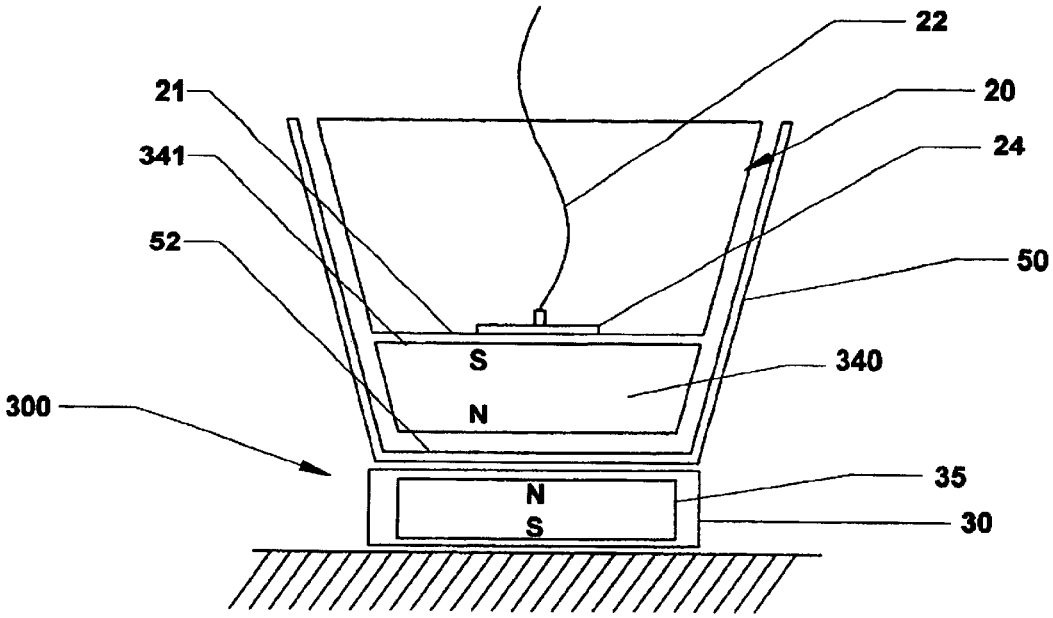
FIG. 9 is a partial cross sectional view of a candle flame extinguisher assembly constructed in accordance with yet a fourth embodiment of the present invention.

Reference is last made to FIG. 9 for a disclosure of yet a fourth embodiment of the present invention. In this fourth embodiment, a candle flame extinguisher assembly, generally indicated at 300, preferably comprises a platform 30, wherein platform 30 includes a first magnet 35 having at least a first polarity, a second magnet 40, the second magnet having a first polarity (i.e. "N") that is repelled by the first polarity (i.e. "N") of first magnet 30, wherein second magnet 340 is positionable in the candleholder and intermediate candle 20 and a base 52 of candleholder 50. Second magnet 340 is initially oriented such that its first polarity is in alignment with the first polarity of the first magnet. Upon a sufficient melting of candle 20 a puddling of melted wax is formed and the repelling force between the respective first polarities of the first and second magnets causes second magnet 340 to be urged away from first magnet 35 in a manner similar to that of FIG. 8. Thus it can be seen that in this embodiment, the urging of second magnet 340 away from first magnet 35 causes the remaining portion of candle 20 to be tipped in a direction (see FIG. 10) such that wick 22 is tipped towards the melted wax and extinguished therein.

To achieve this operation of this embodiment, second magnet 340 has a surface area 341 in facing alignment with a base 21 of candle 20, and wherein the urging of candle 20 in a direction such that the wick 22 is tipped towards the melted wax is due to the force from second magnet 340 upon base 21 of candle 20.

Figure 10:
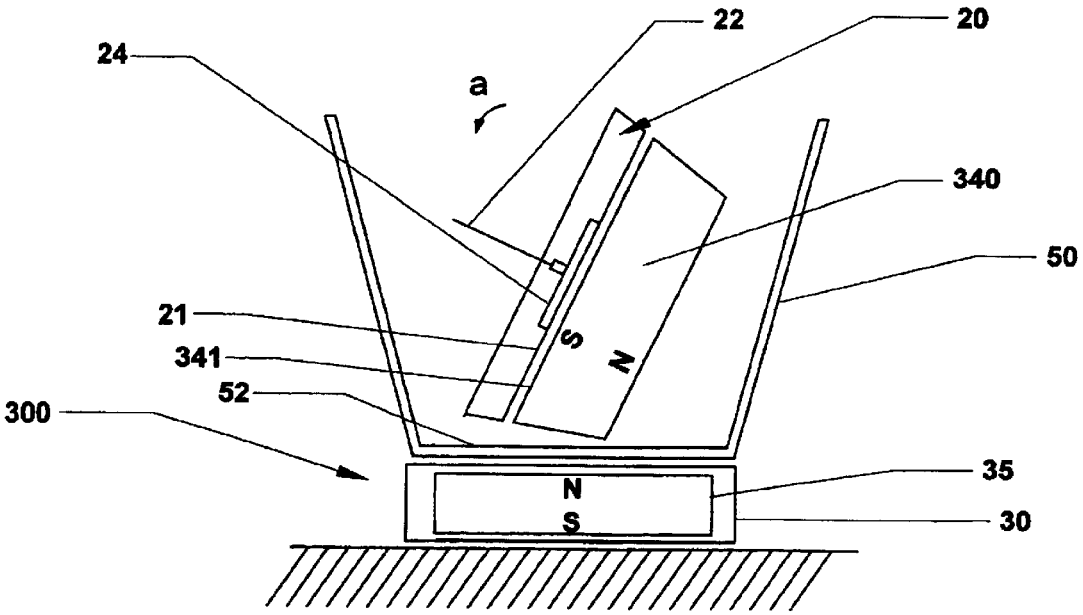
FIG. 10 is an elevational view showing the operation of this fourth embodiment.

As indicated above, the urging force between the two magnets needs to be sufficiently strong enough so as to cause the entire remaining portion of the candle to tip (see arrow "a" in FIG. 10). The repelling force between magnets 35, 340 needs to be great enough to both provide the necessary force to urge/tip the remaining portion of candle 20 over as shown in FIG. 10. Also, as the candle is tipped, the physical distance between the magnet 340 and magnet 35 will increase. The size of the magnets and the weight/size of the candle must therefore be selected to as to ensure the candle can be urged sufficiently over. Again, such minor experimentation is well within the purview of one skilled in the art.

In what is yet a last embodiment, it should be understood that any of the foregoing embodiments can be incorporated into the candle itself. That is, the present invention contemplates that the candle itself would contain a magnet or spring mechanism as disclosed in any one of the first, second or fourth embodiments. That is, there need not be a separate wax insert, as the magnet or spring member may actually be embedded in a bottom part of the candle itself. In this way, the candle itself would provide a built in candle extinguishing assembly as disclosed above. For this last embodiment, the figures should be envisioned to disclose this construction. That is, new drawings to illustrate these features and advantages need not be separately provided as it is sufficient that the above drawings are to be deemed to disclose that the wax inserts or the separate second magnets are actually part of the candle itself. Additional drawings, therefore if needed, would be seen to comprise new matter.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein and all statements of the scope of the invention that as a matter of language might fall therebetween. For example, all the magnets disclosed herein should be understood to include, but not be limited to, ceramic or earth magnets. Moreover, the terms "having" and "including" and all forms thereof should be interpreted as having the same meaning as "comprising," thereby providing the claims with their broadest scope.

What is claimed is:

1. A candle flame extinguisher assembly for extinguishing a flame of a candle positioned in a candleholder, wherein the candle includes a wick and a wickbase, the assembly comprising:

a platform, wherein the platform includes a first magnet having at least a first polarity;

a second magnet, the second magnet being coupleable to the wickbase and having a first polarity that is repelled by the first polarity of the first magnet, wherein the second magnet is positionable in the candleholder and intermediate the candle and a base of the candleholder, the second magnet being initially oriented such that its first polarity is in alignment with the first polarity of the first magnet;

wherein upon a sufficient melting of the candle a puddling of melted wax is formed and the repelling force between the respective first polarities of the first and second magnet causes the second magnet to be urged away from the first magnet; and whereby the wick is tipped in a direction towards the melted wax and extinguished therein due in part to the wickbase being coupled to the second magnet.

2. The candle flame extinguisher assembly as claimed in claim 1, wherein the second magnet is embedded in a wax insert, the wax insert being positionable in the candleholder between the base of the candleholder and the wickbase;

wherein upon the sufficient melting of the candle, the insert is sufficiently melted to at least one of allow the second magnet to couple to the wickbase and permit the second magnet to be urged away from the first magnet.

3. The candle flame extinguisher assembly as claimed in claim 1, wherein the platform is comprised of plastic, clay, metal, wood or ceramic material.

4. The candle flame extinguisher assembly as claimed in claim 1, wherein the wickbase is made of metal and is attracted to a second polarity of the second magnet.

5. The candle flame extinguisher assembly as claimed in claim 2, wherein the wax insert is tapered so as to ensure an alignment of the first polarity of the first magnet and the first polarity of the second magnet.

6. A candle flame extinguisher assembly for extinguishing a flame of a candle positioned in a candleholder, wherein the candle includes a wick and a wickbase, the assembly comprising:

a wax member, into which is embedded:

a base; and a spring member coupled to the base, wherein the spring member comprises a material that is attracted to the wickbase, wherein the wax member is positionable in the candleholder and intermediate the candle and a base of the candleholder, the spring member being in an initially compressed position when embedded in the wax member;

wherein upon a sufficient melting of the candle and wax member, the spring member is urged towards an extended and tilted position so that the wick is tipped in a direction towards the melted wax and extinguished therein.

7. A wax insert for use in a candle flame extinguisher assembly for extinguishing a flame of a candle positioned in a candleholder, wherein the candle includes a wick and a wickbase and the assembly comprises a platform including a first magnet having at least a first polarity, the wax insert comprising:

a second magnet at least partially embedded therein, the second magnet being coupleable to the wickbase and having a first polarity that is repelled by the first polarity of the first magnet; wherein the wax insert is positionable in the candleholder and intermediate the candle and a base of the candleholder, the second magnet being initially oriented such that its first polarity is in alignment with the first polarity of the first magnet;

wherein upon a sufficient melting of the candle and wax insert, a puddling of melted wax is formed and the repelling force between the respective first polarities of the first and second magnet causes the second magnet to be urged away from the first magnet;

wherein the wax insert is tapered so as to ensure an alignment of the same polarities of both the first and second magnets; and whereby the wick is tipped in a direction towards the melted wax and extinguished therein due in part to the wickbase being coupled to the second magnet.

8. A method of extinguishing a flame of a candle positioned in a candleholder, wherein the candle includes a wick and a wickbase, the method comprising the steps of:

providing a magnet intermediate a bottom of the candleholder and the wickbase; coupling the magnet to the wickbase;

allowing the candle to burn sufficiently so that the magnet can be urged upward and rotated in the candleholder; and causing the flame to be extinguished in the melted wax formed from the sufficient burning of the candle by the rotation of the wick due in part to the wickbase being coupled to the magnet.

9. The method as claimed in claim 8, including the steps of:

providing a platform on which sits the candleholder, wherein the platform includes a magnet having at least a first polarity that is repelled by a first polarity of the first mentioned magnet;

wherein the first mentioned magnet is initially oriented in the candleholder such that its first polarity is in alignment with the first polarity of the second mentioned magnet;

wherein upon a sufficient melting of the candle a puddling of melted wax is formed, the step of urging the first mentioned magnet away from the second mentioned magnet due to the repelling force between the respective first polarities thereof;

whereby the wick is tipped in a direction towards the melted wax and extinguished therein.

10. The method as claimed in claim 8, including the step of embedding the magnet in a wax insert.

11. A candle flame extinguisher assembly for extinguishing a flame of a candle positioned in a candleholder, wherein the candle includes a wick and a wickbase, the assembly comprising:

a platform on which the candleholder is positionable, wherein the platform includes a magnet having at least a first polarity in an orientation that creates a repelling force between the first magnet and the wickbase;

wherein upon a sufficient melting of the candle a puddling of melted wax is formed and the repelling force between the first polarity of the first magnet causes the wickbase to be urged away from the magnet; and whereby the wick is tipped in a direction towards the melted wax and extinguished therein due in part to the wickbase being urged away from the magnet.

12. The candle flame extinguisher assembly as claimed in claim 11, wherein the wickbase is made of metal.

13. The candle flame extinguisher assembly as claimed in claim 11, wherein the wickbase is made of a magnetic material, wherein the surface of the wickbase in facing alignment with the first polarity of the magnet is of the same polarity as the first polarity of the magnet.

14. A method of extinguishing a flame of a candle in a candleholder using the assembly of claim 11, comprising the steps of:

providing a candle comprising a wickbase in the candleholder;

placing the candleholder on the platform;

causing the candle to sufficiently melt so that a repelling force between the magnet and the wickbase causes the wickbase to rotate in the melted wax; and causing the flame to be extinguished in the melted wax due to the rotation of the wickbase and the wick being rotated towards the melted wax.

15. A candle flame extinguisher assembly for extinguishing a flame of a candle positioned in a candleholder, wherein the candle includes a wick, the assembly comprising:

a platform, wherein the platform includes a first magnet having at least a first polarity;

a second magnet, the second magnet having a first polarity that is repelled by the first polarity of the first magnet, wherein the second magnet is positionable in the candleholder and intermediate the candle and a base of the candleholder, the second magnet being initially oriented such that its first polarity is in alignment with the first polarity of the first magnet;

wherein upon a sufficient melting of the candle a puddling of melted wax is formed and the repelling force between the respective first polarities of the first and second magnet causes the second magnet to be urged away from the first magnet; and wherein the urging of the second magnet away from the first magnet causes the candle to be tipped in a direction such that the wick is tipped towards the melted wax and extinguished therein.

16. The candle flame extinguisher assembly as claimed in claim 15, wherein the second magnet has a surface area in facing alignment with a base of the candle, and wherein the urging of the candle in a direction such that the wick is tipped towards the melted wax is due to the force from the second magnet upon the base of the candle.

17. The candle flame extinguisher as claimed in claim 15, wherein the second magnet is embedded in a wax insert.

18. The candle flame extinguisher as claimed in claim 15, wherein the second magnet is embedded in the candle.

19. A method of extinguishing a flame of a candle in a candleholder using the assembly of claim 15, comprising the steps of:

providing the second magnet in the candleholder;

providing a candle in the candleholder such that the second magnet is intermediate the candle and the base of the candleholder;

causing the candle to sufficiently melt so that a repelling force between the first and second magnets overcomes the weight of at least the remaining section of the candle and the causes the magnet to be urged to rotate;

wherein the force of the second magnet upon the candle causes the candle to rotate towards the melted wax; and causing the flame to be extinguished in the melted wax due to the rotation of the candle and thus the wick being urged towards the melted wax.

20. A candle with a built in flame extinguishing assembly, the candle to be positioned in a candleholder which itself is positioned on a platform that itself comprises a magnet having at least a first polarity, the candle comprising:

a wick connected to a wickbase;

a second magnet, the second magnet being coupleable to the wickbase and having a first polarity that is repelled by the first polarity of the first magnet, wherein the second magnet is positionable in the candle and intermediate the wickbase and a base of the candleholder, the second magnet being initially oriented such that its first polarity is in alignment with the first polarity of the first magnet;

wherein upon a sufficient melting of the candle a puddling of melted wax is formed and the repelling force between the respective first polarities of the first and second magnet causes the second magnet to be urged away from the first magnet; and whereby the wick is tipped in a direction towards the melted wax and extinguished therein due in part to the wickbase being coupled to the second magnet.

21. A candle with a built in flame extinguishing assembly, the candle to be positioned in a candleholder, the candle comprising:

a wick and a wickbase;

a spring member having a base at one end and coupled to the wickbase at the other, wherein the spring member is initially in a compressed position when embedded in the candle;

wherein upon a sufficient melting of the candle, the spring member is urged towards an extended and tilted position so that the wick is tipped in a direction towards the melted wax and extinguished therein.

22. A candle flame extinguisher assembly for extinguishing a flame of a candle positioned in a candleholder, wherein the candle includes at least a wick, the assembly comprising:

a first magnet, positioned outside the candleholder, such that the base of the candleholder is intermediate a bottom of the candle and the first magnet, wherein the first magnet has at least a first polarity;

a second magnetic material, the second magnetic material being coupleable to the wick and having a first polarity that is repelled by the first polarity of the first magnet, wherein the second magnetic material is positionable in the candleholder, the second magnetic material being initially oriented such that its first polarity is in alignment with the first polarity of the first magnet;

wherein upon a sufficient melting of the candle a puddling of melted wax is formed and the repelling force between the respective first polarities of the first magnet and second magnetic material causes the second magnetic material to be urged away from the first magnet; and whereby the wick is tipped in a direction towards the melted wax and extinguished therein due in part to the wick being coupled to the second magnetic material.

23. The assembly as claimed in claim 21, wherein the candle further includes a wickbase connected to the wick, and wherein the second magnetic material is a magnet separately coupleable to the wickbase.

24. The assembly as claimed in claim 22, wherein the second magnet is embedded in a wax insert, the wax insert being positionable in the candleholder between the base of the candleholder and the wickbase;

wherein upon the sufficient melting of the candle, the insert is sufficiently melted to at least one of allow the separate magnet to couple to the wickbase and permit the separate magnet to be urged away from the first magnet.

25. The assembly as claimed in claim 21, wherein the second magnetic material is embedded in the candle.

26. The assembly as claimed in claim 24, wherein the candle further includes a wickbase connected to the wick, and wherein the second magnetic material is a magnet separately coupleable to the wickbase.

* * * * *